US007055244B2

(12) United States Patent
Bhagwat et al.

(10) Patent No.: US 7,055,244 B2
(45) **Date of Patent: *Jun. 6, 2006**

(54) METHOD OF MANUFACTURING FLAT WIRE COIL SPRINGS TO IMPROVE FATIGUE LIFE AND AVOID BLUE BRITTLENESS

(76) Inventors: Anand Waman Bhagwat, 26935 Ottekee Dr., Perrysburg, OH (US) 43551; Steven Shannon Wray, 401 Penbrooke Dr., Findlay, OH (US) 45840

( * ) Notice: Subject to any disclaimer, the term of this patent is extended or adjusted under 35 U.S.C. 154(b) by 23 days.

This patent is subject to a terminal disclaimer.

(21) Appl. No.: 10/303,532

(22) Filed: Nov. 25, 2002

(65) Prior Publication Data

US 2003/0172531 A1 Sep. 18, 2003

Related U.S. Application Data

(60) Provisional application No. 60/363,970, filed on Mar. 14, 2002.

(51) Int. Cl.
*B23P 13/00* (2006.01)

(52) U.S. Cl. ..... 29/896.9; 29/33 F; 148/595

(58) Field of Classification Search ..... 29/896.9, 29/605, 33 F, 33 Q, 33 S; 148/595
See application file for complete search history.

(56) References Cited

U.S. PATENT DOCUMENTS 350,584 A * 10/1886 Fritts ..... 72/146
401,721 A * 4/1889 Sedgwick ..... 148/576
1,802,299 A * 4/1931 Wine ..... 29/896.9
1,844,699 A 2/1932 Stack
2,043,208 A 6/1936 Bohn
2,157,739 A 5/1939 McBain
2,317,290 A 4/1943 Mcllvried
2,388,537 A * 11/1945 Hallstrom et al. ..... 148/580
2,474,620 A 6/1949 Fath
2,508,153 A 5/1950 Frisch et al.
2,539,540 A 1/1951 Idar et al.
2,647,743 A * 8/1953 Cook ..... 267/156
3,346,938 A * 10/1967 Becker ..... 148/529
3,572,596 A 3/1971 Dykmans
3,692,254 A 9/1972 Ebert et al.
3,788,631 A * 1/1974 Aldous ..... 267/156
3,910,392 A * 10/1975 Foers ..... 192/70.18
3,929,524 A * 12/1975 Filatov et al. ..... 148/576
4,233,089 A * 11/1980 Lanner ..... 148/320
4,575,912 A 3/1986 Grip et al.
4,840,051 A 6/1989 Boratto et al.
4,854,032 A 8/1989 Dambre
4,909,866 A 3/1990 Abe et al.

(Continued)

FOREIGN PATENT DOCUMENTS

SU 990861 A * 1/1983

*Primary Examiner*—Essama Omgba
(74) *Attorney, Agent, or Firm*—Howard M. Cohn

(57) ABSTRACT

The present invention relates to a method of forming a coil of spring wire by winding a wire into a coil spring formed of a plurality of rings of the wire wherein each of the rings has a substantially constant strain rate. The forming speed of the wire being wound is controlled so that each of the rings has a substantially constant strain rate and minimum work hardening occurs.

16 Claims, 2 Drawing Sheets

U.S. PATENT DOCUMENTS 4,938,811 A * 7/1990 Murai et al. ..... 148/595
4,983,227 A * 1/1991 Reiniche et al. ..... 148/500
5,213,637 A 5/1993 Mallen Herrero et al.
5,302,216 A * 4/1994 Sugita et al. ..... 148/595
5,547,532 A 8/1996 Wernersbach, Jr. et al.
5,902,422 A * 5/1999 Meyer et al. ..... 148/595
6,012,668 A 1/2000 Zurfluh et al.
6,149,091 A 11/2000 Poloni et al.
6,152,396 A 11/2000 Rapila et al.
6,338,763 B1 * 1/2002 Hashimura et al. ..... 148/333
6,627,005 B1 * 9/2003 Kawabe et al. ..... 148/226
6,682,612 B1 * 1/2004 Meyer et al. ..... 148/595
2001/0005934 A1 * 7/2001 Nakamura et al. ..... 29/605
2004/0025987 A1 * 2/2004 Bhagwat et al. ..... 148/595

* cited by examiner

METHOD OF MANUFACTURING FLAT WIRE COIL SPRINGS TO IMPROVE FATIGUE LIFE AND AVOID BLUE BRITTLENESS

CROSS-REFERENCE TO RELATED APPLICATIONS

This application claims the benefit of U.S. Provisional Patent Application No. 60/363,970, filed Mar. 14, 2002 by Bhagwat and Wray.

TECHNICAL FIELD

The present invention relates to the manufacture of wire coil springs and more particularly to the method of manufacture whereby dynamic strain aging of wire coil springs is reduced to provide improved fatigue life.

BACKGROUND OF THE INVENTION

Dynamic strain aging (rate of work hardening) of steel wire occurs when the impurity atoms and dislocations interact during wire deformation. The dynamic strain aging for a coil spring of steel wire includes two aspects. One aspect is that the coil spring is dynamically strained and the other aspect is that the coil spring is aged. Depending on the combination of operating conditions, dynamic strain aging can occur during the coiling process. The specified temperature range in which the dynamic strain aging occurs depends on the strain rate, i.e. corresponding to the speed that the wire is pulled into the coil spring machine where the coil is formed. Increasing the strain rate, i.e. by winding the steel wire into a coil at a faster rate, typically raises both the lower and upper temperature limits associated with the dynamic strain-aging phenomenon. For example, at a strain rate of about 560 meters/minute (m/min), dynamic strain aging in the coil occurs by heating the coil to a stress relieving temperature in the range from between about 450° Centigrade (C.) to about 700° C. However, at a strain-rate of about 10 m/min to about 50 m/min, dynamic strain aging in the coil occurs by heating the coil to a much lower temperature range from between about 260° C. to about 300° C.

In metal wire containing interstitial solutes, such as carbon, nitrogen and oxygen in iron, the work hardening rate can become abnormally high during the coil formation. The work hardening rate of the metal wire can also be strain-rate and temperature dependent. Literature has documented that there is a maximum work hardening rate for the metal wire corresponding to a specific strain rate, above and below which the work hardening rate is lower. Further, if the temperature of the metal wire being coiled is raised, the strain rate at which maximum work hardening occurs also rises.

In steel, the dynamic strain-aging phenomenon is frequently called blue brittleness. It occurs approximately at the center of the temperature range in which the dynamic strain aging (heat and cracks) occurs, i.e. where the elongation of the steel wire becomes very small or the wire is drawn with a minimum amount of elongation. In dynamic strain aging, the necking, i.e. reduction in size of the steel wire cross-section, starts under tensile loading conditions at a relatively small strain and increases to highly concentrated strain conditions. The steel wire, however, does not become brittle and the reduction of area does not reach a minimum. Such a minimum in the elongation is not observed in the pure metals or alloys without any interstitial atoms.

There is a need in forming coil springs of steel to reduce the breaking of the wire during manufacture or service due to brittleness caused by the manufacture process.

SUMMARY OF THE INVENTION

It is an aspect of the present invention to prevent dynamic strain aging in spring coiling processes having the capability of being constructed to accomplish one or more of the following subsidiary aspects.

Another aspect of the present invention is to provide spring coiling processes, which reduce the likelihood of center bar breakage (also termed as blue brittleness).

Another aspect of the present invention is to provide a spring coiling process including a combination of strain rate or coiling speed, steel chemistry, and hot-forming temperature during coiling that substantially eliminates the transition zone between the low and high strain rate.

The present invention relates to a method of forming a coil of spring wire comprising the step of winding a wire into a coil spring formed of a plurality of rings of the wire wherein each of the rings has a substantially constant strain rate. The forming speed is controlled so that each of the rings has a substantially constant strain rate and so that minimum work hardening occurs. The forming speed of the wire is less than about 10 m/min and greater than about 50 m/min.

Further according to the present invention, the method includes the steps of: providing a coil of spring wire; attaching an end of a length of spring wire being unwound from the coil of wire to a coiling point or rotatable shaft of a spring coiling machine; heating a section of the length of wire between the coil and the coiling point to a temperature to soften the wire; rotating the rotatable shaft to form a coil of a plurality of rings of the spring wire; and cutting the length of wire between the section of the length of wire and the rotatable center shaft.

Also according to the present invention, the method further includes the step of heating the coil spring to a softening temperature that is dependent on strain rate so that the elongation properties are equalized across the coil rings.

According to the present invention, the method includes the step of selecting the wire with a cross sectional shape selected from the group comprising flat, oval, round, circular and rectangular cross sectional shapes. The wire can be selected from steel with less than about 0.66% carbon.

Further according to the present invention, the method includes the step of selecting the steel chemistry of spring wire to allow winding the spring wire in the range about 10 m/min to about 50 m/min without dynamic strain aging. The method also includes the step of selecting steel chemistry of spring wire wherein interstitial elements from the group of nitrogen and oxygen are in combined form with other additions of any alloying elements in steel that form compounds with nitrogen to prevent presence of free nitrogen whereby dynamic strain aging is avoided. The method also includes the step of selecting steel chemistry of spring wire wherein other additions of any alloying elements in steel that form compounds with nitrogen are selected from the group comprising boron, aluminum and titanium to prevent presence of free nitrogen. The method further includes the step of adding the other additions of alloying elements in an amount at least equal to the stoichiometric ratio to form a compound with the interstitial element.

According to another embodiment of the present invention, a method of forming a coil of spring wire is disclosed comprising the steps of: providing a coil of steel wire with less than about 0.66% carbon; attaching an end of a length of spring wire being unwound from the coil of wire to a rotatable center shaft of a spring coiling machine; heating a section of the length of wire between the coil and the center shaft to a temperature to soften the wire; rotating the rotatable center shaft to form a coil of a plurality of rings of the spring wire wherein each of the rings has a substantially constant strain rate; and cutting the length of wire between the section of the length of wire and the rotatable center shaft.

Further according to the present invention, the method includes the step of selecting steel chemistry of spring wire wherein interstitial elements from the group of nitrogen and oxygen are in combined form with other additions of any alloying elements in steel that form compounds with nitrogen to prevent presence of free nitrogen whereby dynamic strain aging is avoided. The method also includes the step of selecting steel chemistry of spring wire wherein other additions of any alloying elements in steel that form compounds with nitrogen are selected from the group comprising boron, aluminum and titanium to prevent presence of free nitrogen. The method also includes the step of adding the other additions of alloying elements in an amount at least equal to the stoichiometric ratio to form a compound with the interstitial element.

Also according to the present invention, the method includes the step of winding the spring wire at a variable-strain rate outside of the range of between about 10 m/min to about 50 m/min where work-hardening rate is at a maximum.

Further according to the present invention, the method includes the step of selecting steel chemistry of spring wire to allow winding the spring wire in the range about 10 m/min to about 50 m/min without dynamic strain aging.

According to another aspect of the present invention, a method of forming a coil of spring wire is disclosed comprising the steps of: providing a coil of steel wire with less than about 0.66% carbon and steel chemistry of spring wire wherein interstitial elements from the group of nitrogen and oxygen are in combined form with other additions of any alloying elements in steel that form compounds with nitrogen to prevent presence of free nitrogen; and winding the steel wire at a variable-strain rate into a coil spring at ambient temperature to avoid dynamic strain aging. The method includes the step of selecting the alloying elements from the group comprising boron, aluminum, and titanium.

BRIEF DESCRIPTION OF THE DRAWINGS

The structure, operation, and advantages of the invention will become further apparent upon consideration of the following description taken in conjunction with the accompanying drawings, wherein.

DETAILED DESCRIPTION OF THE PREFERRED EMBODIMENT

Figure 1:
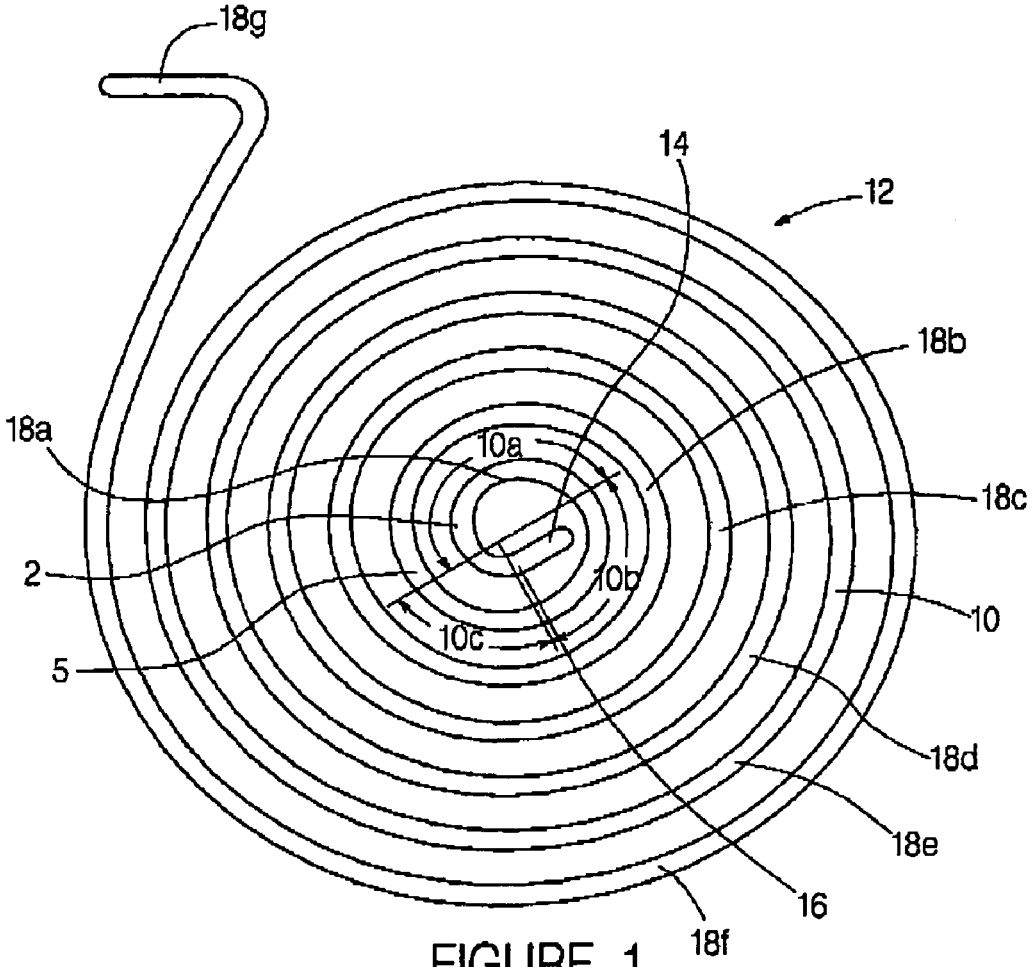
FIG. 1 is a cross-sectional view of a flat wire coil spring.

The present invention relates to a manufacturing process for coiling a wire 10 (preferably, but not limited to steel) into a coil spring 12, as shown in FIG. 1. The wire 10 used in the present invention, such as for example 1060 steel with 0.63% carbon, can contain carbon atoms as interstitials. After the wire 10 is drawn or rolled from a steel rod, the wire is preferably quenched and tempered to a desired hardness and tensile strength. The wire 10, while discussed herein as being flat, can have any desired cross-sectional shape selected from the group comprising flat, oval, circular and rectangular cross-sectional shapes. While many cross-sectional shapes are within the scope of the present invention, typically the cross section is flat or round.

Figure 2:
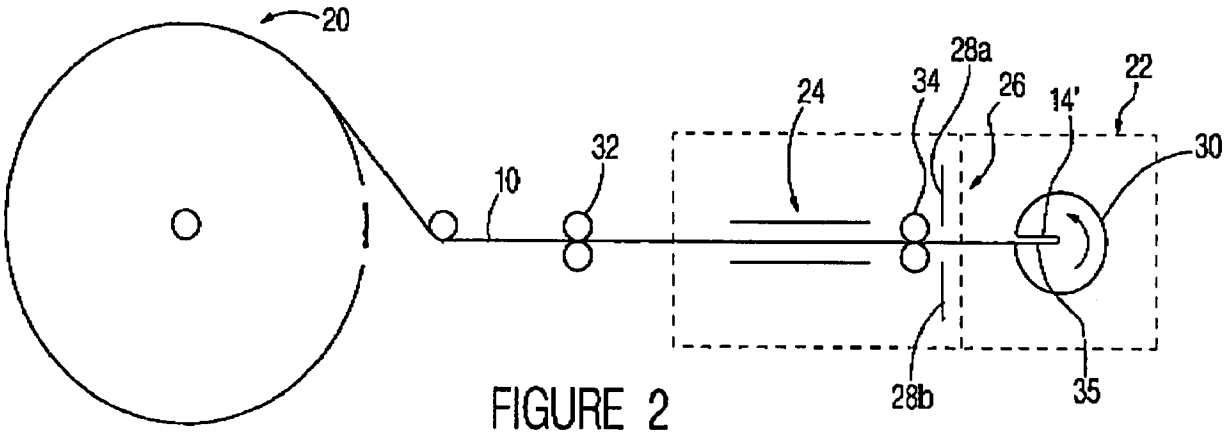
FIG. 2 is a schematic illustration of a spring coiling assembly machine.

Generally, in making a coil spring 12 from wire 10, a coil 20 of steel wire 10 is rotatably mounted near a conventional spring coiling machine 22 (shown in schematic as shown in FIG. 2). The coiling machine 22 includes a heat station 24; a cutting station 26, such as opposed shears 28*a*, 28*b*; and a rotatable center shaft (arbor) 30. The wire strip 10 can be fed by means, such as delivery rollers 32 and 34, through the heat station 24 where a section of wire is heated to an elevated temperature to soften the wire. The wire 10 is then cut at cutter station 26.

Figure 3:
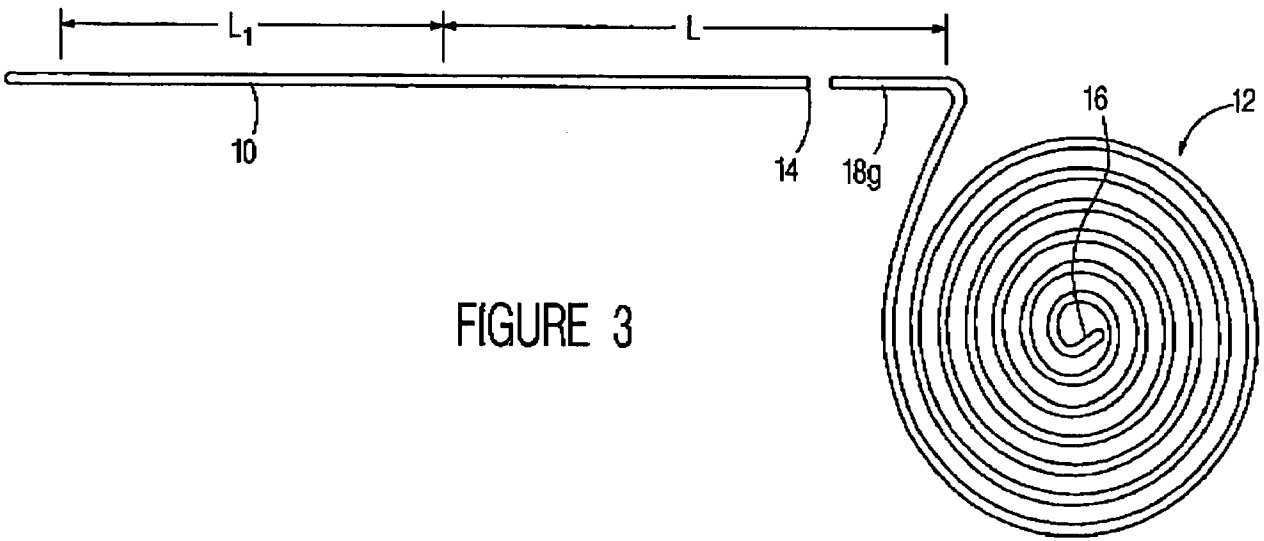
FIG. 3 is a cross-sectional view of the wire being fed through the spring coiling assembly machine of FIG. 2 to form a flat wire coil spring.

As shown in FIG. 3, the trailing end 18*g* of the coil spring 12, being soft is bent with respect to the outer coil 18*f* as shown in FIGS. 1 and 3. The leading end 14 of the wire 10 being unwound from the coil 20 forms the center bar 16 of the next coil spring 12 being formed. The end 14 of the wire 10 being drawn off the coil 20 is inserted into a slot 35 formed in the center shaft 30 of the spring coiling machine 22 and attached to the center shaft by bending the end 14, as shown in FIGS. 1 and 3, to form the center bar section 16. The center shaft 30 is typically rotated at a constant speed while the wire 10 is pulled into the conventional spring coiling machine 22 at a variable speed. This variation in speed is caused by the center ring or coil 18*a* of the coil spring 12 being wound into a coil shape more quickly than the outer rings or coils, i.e., 18*b*, 18*c*, 18*d*, 18*e*, 18*f* (18*b*–18*f*). This difference in speed is because as the coil 12 becomes larger (bigger outer diameter), more wire 10 is needed to form each successive outer ring. In other words, as the diameter of the coil spring 12 increases, each successive outer ring 18*b*–18*f* is being wound into a coil shape faster than the adjacent previous inner ring, i.e., 18*d* is wound into a coil faster than 18*c*. The result is that the strain rate of each ring 18*b*–18*f* is higher than the adjacent inner ring as the coil spring 12 is wound. The increase in strain rate from the center coil ring 18*a* to the outer coil 18*f* leads to a transition zone of low and high strain rates with different dynamic strain aging temperatures. Thus, the coil spring 12 has incompatible elongation properties that are not equalized across the coils 18*a*–18*f* when the later are subjected to being heated to a threshold temperature while heating the leading end 14 to provide center bar formation, i.e. the softening temperature to which the coil spring wire is subjected prior to forming. Using the apparatus and methods of the prior art, the wire coil spring 12 had a propensity to break in ring 18*b* opposite from the straight section 16, as shown in FIG. 1.

The propensity to break in ring 18*b* opposite from the straight section 16, as shown in FIG. 1, can be better understood from the following explanation. Referring again to FIG. 3, when the wire 10 is heated by a heater 24, a length L of the wire 10 is heated to the highest temperature to soften the wire section L so that the leading end 14 can be bent into the straight section 16 and the trailing end of the coil 18*g* can be bent as shown in FIGS. 1 and 3. Besides heating length L, an adjacent length $L_1$ extending from the wire 10 being unwound from the coil 20, retains consequential heat passing down the wire from the length L. In the example of heating length L to a softening temperature at elevated degrees, the adjacent length $L_1$ is consequentially heated to a lower temperature of about 260 degrees C.

Referring to FIG. 1, the section 10*a* of the wire forming the coil spring extending from the straight section 16 about 180° to section 10*b* has sufficiently softened so that the bending does not overly stress the coil spring 12 in this area. The section 10*b* of wire 10 extending from the section 10*a* for about 90° to section 10*c* has been highly stressed as a result of the combination of consequential heat and strain, and has the highest probability of breaking during spring manufacture or service. The section 10*c* of wire 10 extending from the section 10*b* for about 90° has been slightly stressed by the consequential heat but not enough to have a high probability of breaking during spring manufacture or service.

The present invention relates to several methods and apparatus for forming a coil wire spring that has a reduced propensity to break during manufacture or service due to brittleness caused by the manufacture process.

According to a first embodiment of the present invention, the coil spring can be wound based on the principles described herein below.

The spring wire 10 is wound onto the shaft 30 of a spring coiling machine 22 at a varied rotational speed so that the coil 12 of spring wire is formed at a substantially constant strain that substantially eliminates the transition zone between the low and high strain rate. That is, the transition zone between the low and high strain rate caused by each successive outer ring of wire being wound into the coil shape faster than the adjacent previous inner ring results in the strain rate of each ring being higher than the adjacent inner ring, as previously described hereinbefore, being reduced or eliminated.

Moreover, the method includes the step of winding the spring wire 10 into coil spring 12 at a constant-strain rate whereby minimum work hardening occurs so that there is no need for stress relieving treatment required after winding operation.

Even in a case where the coil spring 12 is subjected to the annealing temperature to which the coil spring can be subjected during forming, without a transition zone of low and high strain rates with different dynamic strain aging temperatures, the resulting coil spring has relatively compatible elongation properties that are equalized across the coils at the stress-relieving temperature.

The method further includes the step of winding the spring wire 10 at a constant-strain rate outside of the range of between about 10 m/min to about 50 m/min where work-hardening rate is at a maximum.

Another embodiment of the present invention is to control the steel chemistry with controlled impurity atoms and interstitial elements. Because of minimum work hardening in the prescribed strain rate, there is no need for stress relieving treatment after coiling of the spring wire coil. Further, the method includes selecting spring wire of steel and limiting the amount and form of the interstitial elements. Particularly, carbon content in the steel wire is maintained below about 0.63% at a given temperature of about 300 C. The temperature at which this phenomena occurs depends on the strain rate and carbon content. That is, with a lower strain rate, the temperature at which dynamic strain aging occurs is also lower. Conversely, the higher the carbon content, the lower is the strain aging temperature.

Another aspect of steel chemistry to be controlled is the carbon content. In typical 1060 steel, by limiting the carbon content in the steel to below about 0.66% and preferably about 0.63% and keeping nitrogen and oxygen in combined form, it has been found that dynamic strain aging is reduced. Other interstitial elements to be controlled are selected from the group comprising nitrogen and oxygen. The method includes additions of any alloying elements in steel that form compounds with nitrogen, such as boron, aluminum and titanium, to prevent presence of free nitrogen. The method requires that the amount of these elements be added at least equal to the stoichiometric ratio to form a compound with the interstitial element, i.e. to tie up all of the free nitrogen in compound.

Some of the advantages of the present invention are:

a. Significant improvement in spring fatigue strength;

b. Reduction in blue brittleness; and c. Increased productivity because of the elimination of the need for post-winding stress relief by heating the coil to a stress relieving temperature.

EXAMPLES

Below are several examples of processing wire into a coil of wire that were either successful or not successful in accordance with the principles of the present invention.

In the first example, the carbon content in the steel was above 0.63% and the nitrogen and oxygen were not kept in the combined form and the wire was coiled at a constant-strain rate of between about 10 m/min to about 50 m/min, the range between which the work-hardening rate is maximum.

Example 1

Steel wire of dimensions 2.50 mm in thickness and 12.0 mm in width in a hardened and tempered condition was coiled at a constant linear speed of 15 m/min. The steel wire had the following chemistry (by weight):

| | |
|---|---|
| Carbon | 0.65% |
| Manganese | 0.73% |
| Silicon | 0.24% |
| Nitrogen | 0.005% |

The wire was consequentially heated in the section $L_1$, see FIG. 3, to a temperature of between 250° C. and 300° C. There was no addition of boron, aluminum, or titanium to form compound with nitrogen. Therefore, nitrogen was left in free form. As expected, the wire consistently broke during winding.

Example 2

In the second example, the carbon content in the steel was above 0.63% and the nitrogen was not kept in the combined form and the wire was coiled at a constant-strain rate of below about 10 m/min to about 50 m/min, the range between which the work-hardening rate is maximum.

Steel wire of dimensions 2.50 mm in thickness and 12.0 mm in width in a hardened and tempered condition was coiled at a constant linear speed of 6 m/min. The steel wire had the following chemistry (by weight):

| | |
|---|---|
| Carbon | 0.65% |
| Manganese | 0.73% |
| Silicon | 0.24% |
| Nitrogen | 0.005% |

There was no addition of boron, aluminum, or titanium to form compound with nitrogen. Therefore, nitrogen was left in free form. The wire was residually heated in the section $L_1$, see FIG. 3, to an approximate temperature of 300° C. As expected from the principles of the present invention, since the wire was coiled at a constant-strain rate below the range of 10 m/min to about 50 m/min, the range between which the work-hardening rate is maximum, the wire did not brake during winding.

Example 3

Steel wire of dimensions 3.0 mm in thickness and 12.0 mm in width in a hardened and tempered condition was coiled at a constant linear speed of 15 m/min. The steel wire had the following chemistry (by weight) where the carbon content was maintained below 0.63%:

| | |
|---|---|
| Carbon | 0.61% |
| Manganese | 0.74% |
| Silicon | 0.20% |
| Nitrogen | 0.004% |
| Boron | 0.006% |

With the addition of boron, the free nitrogen was tied in a compound form as boron nitride. Similar effect could have also been achieved by adding titanium.

The wire was consequentially heated in the section $L_1$, see FIG. 3, to an approximate temperature of between 225° C. and 325° C. The wire did not break during winding, thus the proof that there was no dynamic strain aging.

In the third example, even though the wire was coiled at a constant linear speed of between about 10 m/min to about 50 m/min, the range between which the work-hardening rate is maximum, the carbon content in the steel was below 0.63% and the nitrogen was kept in the combined form. Accordingly, as expected from the principles of the present invention, the wire did not brake during winding.

This leads to a very important advantage of the present invention. Because of minimum work hardening in the prescribed strain rate, there is no need for stress relieving treatment after coiling of the spring wire coil.

That is, by limiting the carbon content in the steel to below 0.66% and keeping nitrogen and oxygen in combined form, it has been found that dynamic strain aging is reduced. This leads to a very important advantage of the present invention.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations.

The invention claimed is:

1. A method of forming a coil spring from spring wire on a rotatable center shaft of a spring coiling machine comprising the steps of:

providing a coil of spring wire;

attaching an end of a length of the spring wire being unwound from the coil of spring wire to the rotatable center shaft of the spring coiling machine; and winding the spring wire onto the rotatable shaft of the spring coiling machine by varying a rotational speed of the rotatable shaft to form a coil spring formed of a plurality of rings wherein during winding of the spring wire onto the rotatable shaft, the spring wire is pulled into the spring coiling machine at a constant linear speed and each successive outer ring of the coil spring is wound into the coil spring at a rotational speed that is faster that the rotational winding speed of the previous ring, so that each of the plurality of rings is formed at a substantially constant strain rate.

2. The method of claim 1 wherein the spring wire is pulled into the spring coiling machine, at a constant linear speed in the range of between about 10 m/min and about 50 m/min so that each of the plurality of rings is formed at a substantially constant strain rate.

3. The method of claim 2 further including the steps of:

heating a section of the length of wire between the coil of spring wire and the rotatable shaft to a temperature to soften the wire; and cutting the length of wire between the section of the length of wire and the rotatable shaft.

4. The method of claim 1 further including the stop of:

heating the coil spring to a softening temperature that is dependent on strain rate, so that the elongation properties are equalized across the rings of the coil spring.

5. The method of claim 1 further including the step of selecting the spring wire with a cross sectional shape selected from the group comprising flat, round, oval, circular and rectangular cross sectional shapes.

6. The method of claim 1 further including the step of selecting the spring wire from steel with less than about 0.66% carbon.

7. The method of claim 1 further including the step of: selecting steel chemistry of the spring wire to allow winding the spring wire at a forming speed in the range about 10 m/min to about 50 m/min without dynamic strain aging.

8. The method of claim 7 further including the step of selecting steel chemistry of the spring wire wherein interstitial elements from the group of nitrogen and oxygen are in combined form with other additions of any alloying elements in steel that form compounds with nitrogen to prevent presence of free nitrogen whereby dynamic strain aging is avoided.

9. The method of claim 8 further including the step of selecting steel chemistry of the spring wire wherein other additions of any alloying elements in steel that form compounds with nitrogen are selected from the group comprising boron, aluminum and titanium to prevent presence of free nitrogen.

10. The method of claim 9 further including the step of adding the other additions of alloying elements in an amount at least equal to the stoichiometric ratio to form a compound with the interstitial element.

11. A method of forming a coil spring from wire on a rotatable shaft of a spring coiling machine comprising the steps of:

providing a coil of steel wire with less than about 0.66% carbon attaching an end of a length of the steel wire being unwound from the coil of steel wire to the rotatable shaft of the spring coiling machine;

heating a section of the length of steel wire between the coil of steel wire and the rotatable shaft to a temperature to soften the steel wire;

rotating the rotatable shaft to form the coil spring of a plurality of rings of spring wire;

winding each successive outer ring of spring wire into the coil spring at a rotational speed that is faster than the rotational winding speed of the previous ring such that the steel wire is pulled into the spring coiling machine at a constant linear speed in the range of between about 10 m/min to about 50 m/min by varying the rotational speed of the rotatable shaft so that each ring of the pOlurality of rings is formed at a substantially constant strain rate; and cutting the length of steel wire in the section of the length of steel wire between the coil of steel wire and the rotatable center shaft.

12. The method of claim 11 further including the step of selecting steel chemistry of the spring wire wherein interstitial elements from the group of nitrogen and oxygen are in combined form with other additions of any alloying elements in steel that form compounds wit nitrogen to prevent presence of free nitrogen whereby dynamic strain aging is avoided.

13. The method of claim 12 further including the step of selecting steel chemistry of the spring wire wherein other additions of any alloying elements in steel that form compounds with nitrogen are selected from the group comprising boron, aluminum and titanium to prevent presence of free nitrogen.

14. The method of claim 13 further including the step of adding the other additions of alloying elements in an amount at least equal to the stoichiometric ratio to form a compound with the interstitial element.

15. A method of forming a coil spring from steel wire on a rotatable center shaft of a spring coiling machine comprising the steps of:

providing a coil of the steel wire with less than about 0.66% carbon and steel chemistry of the steel wire wherein interstitial elements from the group of nitrogen and oxygen are in combined form with other additions of any alloying elements in steel that form compounds with nitrogen to prevent presence of free nitrogen;

attaching an end of a length of the steel wire being unwound from the coil of steel wire to the rotatable center shaft of the spring coiling machine; and winding the steel wire with the spring coiling machine to form a coil spring of a plurality of rings by varying a rotational speed of the rotatable center shaft such that each successive outer ring of the coil spring is wound into the coil spring at a rotational speed that is faster than the rotational winding speed of the previous ring, thereby pulling the steel wire into the spring coiling machine at a constant linear speed in the range of between 10 m/min to about 50 m/min so that each ring of the plurality of rings is formed at a substantially constant strain rate.

16. The method of claim 15 further including the step of selecting the alloying elements from the group comprising boron, aluminum and titanium.

* * * * *

UNITED STATES PATENT AND TRADEMARK OFFICE

CERTIFICATE OF CORRECTION

PATENT NO. : 7,055,244 B2
APPLICATION NO. : 10/303532
DATED : June 6, 2006
INVENTOR(S) : Bhagwat et al.

It is certified that error appears in the above-identified patent and that said Letters Patent is hereby corrected as shown below:

Column 8
Line 27, the word “stop” should be corrected to “step”;
Line 64, after the word “carbon” a semicolon should be inserted;

Column 9
Line 13, the word “pOlurality should be “plurality’;
Line 23, the word “wit” should be “with”

Signed and Sealed this

Fifteenth Day of August, 2006

JON W. DUDAS
*Director of the United States Patent and Trademark Office*